United States Patent [19]

Ihde

[11] Patent Number: 4,558,814

[45] Date of Patent: Dec. 17, 1985

[54] REINFORCEMENT FOR BOTTOM MAJOR HORIZONTAL SCORE LINE OF CONTAINER

[75] Inventor: Richard C. Ihde, Strongsville, Ohio

[73] Assignee: Champion International Corporation, Stamford, Conn.

[21] Appl. No.: 560,890

[22] Filed: Dec. 14, 1983

[51] Int. Cl.[4] ..... B65D 5/08

[52] U.S. Cl. ..... 229/17 R; 229/17 G; 229/37 R; 229/DIG. 9

[58] Field of Search ..... 229/17 R, 17 G, 37 R, 229/DIG. 9, 48 T, 38, 39 R

[56] References Cited

U.S. PATENT DOCUMENTS

| | | | |
|---|---|---|---|
| 1,882,133 | 10/1932 | Fischer | 229/DIG. 9 |
| 2,190,479 | 2/1940 | Moore | 229/48 T |
| 2,333,330 | 11/1943 | Moore | 229/48 T |
| 3,197,112 | 7/1965 | Meyer-Jagenberg | 229/37 R |
| 3,294,310 | 12/1966 | Miller et al. | 229/48 T |
| 3,460,739 | 8/1969 | Asman | 229/17 G X |
| 3,604,613 | 9/1971 | Haas | 229/17 G X |
| 4,318,479 | 3/1982 | Lisiecki | 229/17 G X |

FOREIGN PATENT DOCUMENTS

| | | | |
|---|---|---|---|
| 1122346 | 8/1968 | United Kingdom | 229/37 R |

*Primary Examiner*—William T. Dixson, Jr.
*Assistant Examiner*—Gary E. Elkins
*Attorney, Agent, or Firm*—Evelyn M. Sommer

[57] ABSTRACT

A reinforcement is secured across the bottom major horizontal score of a container in the region of the side seam flap in order to prevent opening or extension of the horizontal score in the side seam flap in the area of the side seam while forming the container or under the gravitational force of the fluid contained within the container.

3 Claims, 10 Drawing Figures

FIG. 6
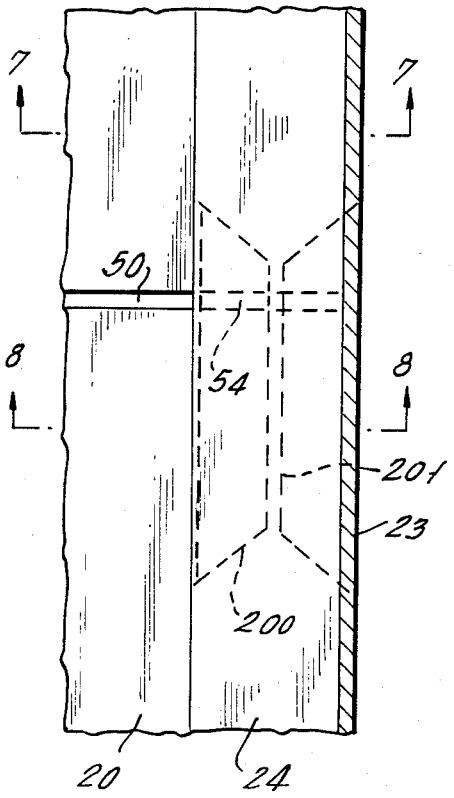
FIG. 7
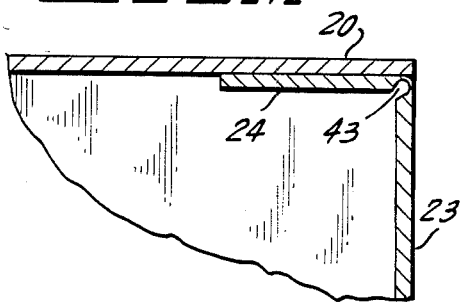
FIG. 8
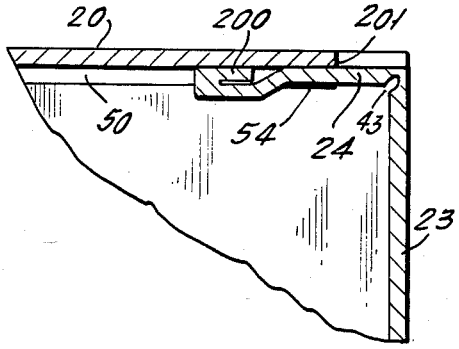
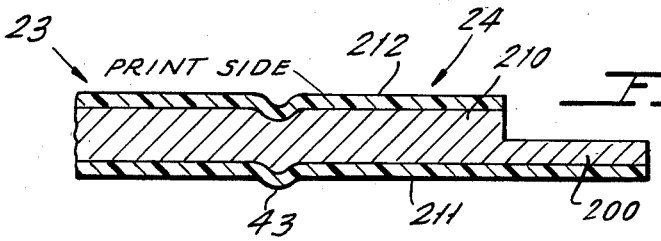
FIG. 1a
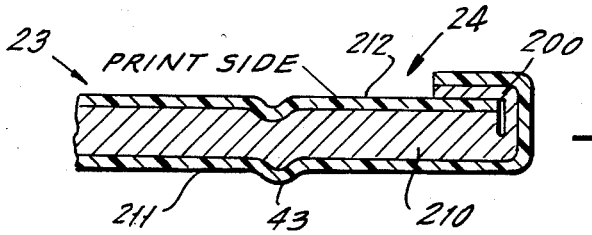
FIG. 1b

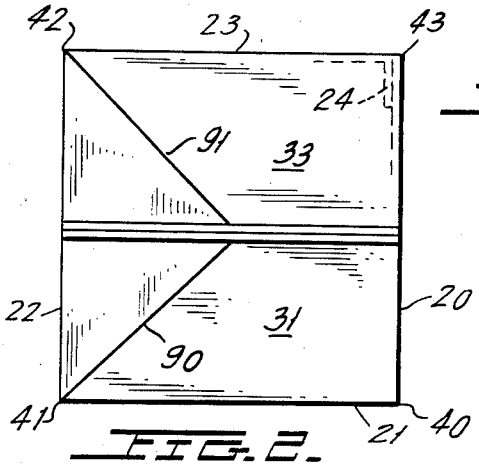
FIG. 4.
FIG. 2.
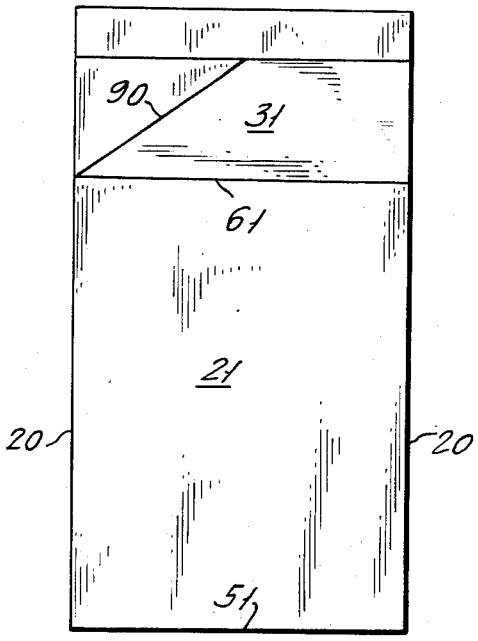
FIG. 3.
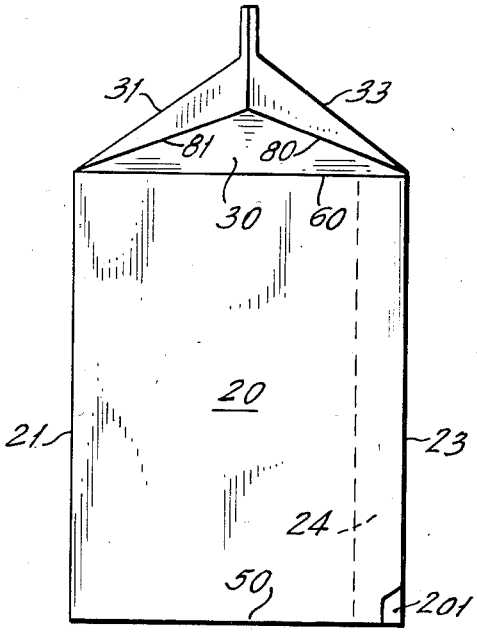
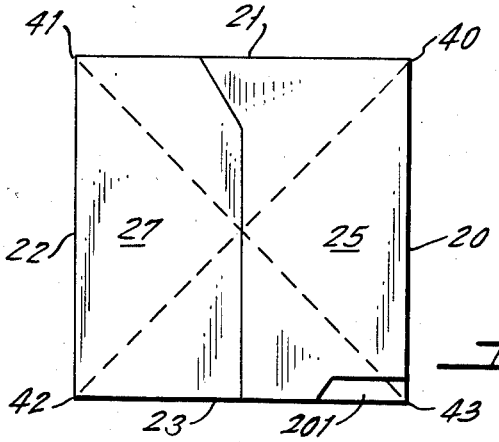
FIG. 5.

REINFORCEMENT FOR BOTTOM MAJOR HORIZONTAL SCORE LINE OF CONTAINER

BACKGROUND OF THE INVENTION

This invention relates to liquid containers which are formed from flat blanks having score regions which define fold lines for the blanks and more particularly relates to a novel structure for a scored blank which provides reinforcement at a container bottom horizontal score adjacent the side seam flap to prevent leakage at that point.

Plastic coated cardboard containers formed from prescored blanks are well known and are in common use, for example, for containing liquids such as milk, fruit juice and the like. These containers frequently have a gabled top which is arranged to define a pouring spout when the top is opened. The container is formed from a single prescored blank of a paperboard material that is typically referred to in the trade as food-board and foodboard which is coated with plastic, such as polyethylene, which permits the formation of heat seals to secure together the blank. A single, generally continuous horizontal score extends across the bottom of each of the panels forming the sides of the container and defines respective bottom flaps. The score is made in a conventional manner and generally consists of a U-shaped depression in the blank material. Such blanks are folded and sealed in the form of a container as by heat sealing or gluing or any other desired process.

It has been found that the bottom horizontal score in the region of the side seam flap tends to open or extend fully when the bottom of the container is formed and with pumping action which may occur during transport of the liquid filled container. The opening of the horizontal score can sometimes weaken the corner of the container to the point of failure.

BRIEF DESCRIPTION OF THE INVENTION

In accordance with the present invention, a novel unscored tab is formed integrally with the free edge of the side seam flap of the container blank. The tab extends perpendicularly across the end of the major bottom horizontal score in the side seam flap. The tab thickness is preferably reduced by rabbiting its surface from the print side of the blank to a relatively small thickness. The tab is then folded back over the raw edge onto the side seam flap and is appropriately sealed thereto to define a unscored material bridge extending across the bottom major horizontal score of the side seam flap.

When the container is formed, the tab is sealed to and also extends across the horizontal score between the main vertical panel to which the side seam flap is secured and its bottom flap. The unscored tab material bridge thus prevents the opening or spreading of both horizontal scores in the region of the side seam flap seal, thereby to ensure against accidental leakage at the container corner.

In forming the novel tab structure of the invention in the blank, the tab can be taken from a notch in the adjacent blank during the cutting of the blanks. This notch does not weaken the container structure since the notch extends outside of the sealed area and outside of the reinforcing bridge of the novel tab which extends across the bottom major horizontal scores in the side seam flap region.

BRIEF DESCRIPTION OF THE DRAWINGS

FIG. 1*a* is a cross-sectional view of the side seam flap of FIG. 1 with the dimensions greatly exaggerated for clarity and shows the tab structure of FIG. 1 after it is rabbited from the print side.

FIG. 1*b* shows the rabbited tab of FIG. 1*a* bent around the raw edge of the side seam flap and sealed to the print side of the flap.

FIG. 2 is an elevation view of the container which is erected from the blank of FIG. 1.

FIG. 3 is a side view of FIG. 2.

FIG. 4 is a top view of FIG. 2.

FIG. 5 is a bottom view of FIG. 2.

FIG. 6 is a cross-sectional view through the assembled container of FIGS. 2 to 5 and particularly shows the side seam flap after its printed surface has been sealed to the inside surface of the panel and bottom flap to which it is secured.

FIG. 7 is a cross-sectional view of FIG. 6 taken across the section line 7—7 in FIG. 6.

FIG. 8 is a cross-sectional view of FIG. 6 taken across the section line 8—8 in FIG. 6.

DETAILED DESCRIPTION OF THE DRAWINGS

Figure 1:
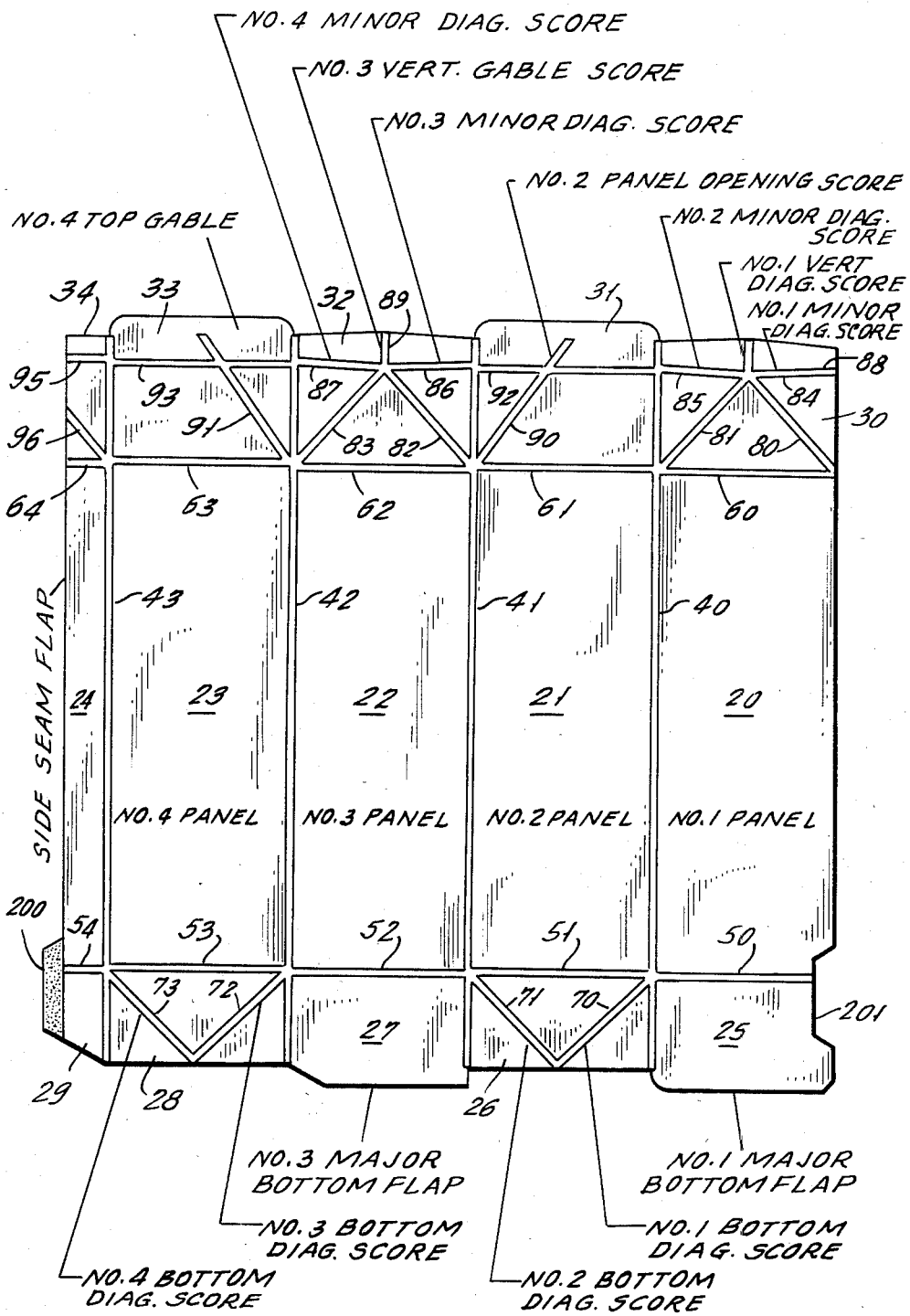
FIG. 1 is a plan view of the inside surface of a plastic coated blank which employs the novel tab structure of the present invention.

Referring first to FIG. 1, there is shown the inside surface of a typical blank which can be erected to form a generally rectangularly shaped carton. By inside surface is meant the surface which will be in the interior of the container or carton which is to be formed. The blank consists, for example, of a plastic coated foodboard. The foodboard may conventionally have a thickness of about 14 to 28 mils. The plastic coating, which may be polyethylene, may have a thickness on the inner and outer surfaces of about 1 mil. These thicknesses can vary, as desired.

The major walls or vertical panels of the blank consist of four panels 20, 21, 22 and 23 which are conventionally known as No. 1 through No. 4 panels as labeled. A side seam flap 24 is integrally joined to the No. 4 panel 23.

Bottom flaps 25 through 29 are integrally joined to the bottoms of panels 20, 21, 22, 23 and 24, respectively. Bottom flaps 25 and 27 are commonly known as the No. 1 major bottom flap and the No. 3 major bottom flap, respectively. Flap 26 consists of two bottom sections labeled as No. 1 bottom and No. 2 bottom and flap 28 also consists of two bottom sections labeled No. 3 bottom and No. 4 bottom. Also provided are upper panel sections 30 to 34 which are connected at the tops of members 20 to 24, respectively. Panels 31 and 33 are commonly known as the No. 2 top gable and No. 4 top gable sections since they form the well known gable-shaped closure.

Panels 20 to 24 and their respective upper and bottom flaps are separated by the major vertical scores 40 to 43 respectively. The various bottom flaps 25 to 29 are defined by bottom major horizontal scores 50 to 54. There are also provided top major horizontal scores 60 to 64 which join the major panels 20 to 24 to the top panels 30 to 34, respectively.

In order to define an appropriate fold for the bottom of the container, the major bottom flap 26 and the major bottom flap 28 are each provided with diagonal scores 70–71 and 72–73, respectively. The top flaps 30 and 32 are also provided with major diagonal scores 80–81 and 82–83, respectively, and with minor diagonal scores 84–85 and 86–87, respectively. Flaps 30 and 32 are also provided with respective vertical gable scores 88 and 89, respectively. Flaps 31 and 33 are provided with opening scores 90 and 91, respectively, and with horizontal scores 92 and 93, respectively. The upper side flap panel 34 is also provided with a horizontal score 95 and a diagonal score 96.

The arrangement described to this point is a conventional blank structure for making the well-known carton identified by the trademark PURE-PAK. Thus, the panel can be folded on the various score lines to define the type of carton shown, for example, in FIGS. 2 to 5 where the panels similar to those of FIG. 1 have been given the same identifying numerals.

In order to erect the prior art container, the blank is first folded on the major vertical scores 40 to 43 to form a rectangular tube. The print side of the side seam flap 24 is then sealed to the inside edge of panel 20. The seal can be a heat seal between the plastic coated surfaces or can be a glue seal or the like. Thereafter, the bottom flaps 25 to 29 are folded upwardly with flaps 26 and 28 folding on their diagonal score lines such that the print surfaces of flaps 26 and 28 are superimposed atop one another and so that the flaps 25 and 27 sequentially fall atop the folded bottom panels 70 and 72. Thereafter, the entire bottom is appropriately heat sealed together.

After filling the container, the top panels 30 to 34 are folded inwardly to form the gabled top structure. The upper surfaces of the gabled structure defined by the stacked surfaces disposed above horizontal score lines 84, 92, 86, 93 and 95 are then sealed together to seal the container interior so that it will have the shape shown in FIGS. 2 to 5. The container may be easily opened simply by prying apart the sealed upper surface and folding out a spout formed in the upper flap 32 by inverting the fold of the diagonal scores 82 and 83.

In accordance with the present invention and as shown in FIG. 1, the blank and the container made therefrom, as described above, are modified to have an unscored tab 200 extending from the free edge of side seam flap 24 and from the bottom of the side seam flap 24 and across the bottom major horizontal score 54. Tab 200 can have a width of about ⅛" and a length of about 1 inch. The material for the tab 200 can be obtained from an adjacent blank (not shown) which will be left with a corresponding notch or cutout such as the notch or cutout 201 shown in the right-hand side of the blank of FIG. 1. Thus, very little change is necessary in the prior art blank structure and tooling to create a blank which incorporates the structure of the present invention. Note that the location of notch 201 does not interfere with the integrity of the carton as shown in FIGS. 2, 5, 6 and 8.

After forming the tab 200 in the blank, the upper surface of the tab is rabbited from the print side, down to a thickness, for example, of 5–7 mils. This rabbited area is shown best in FIGS. 1*a* and 1*b* which show the blank structure in the area of the tab 200 in greatly exaggerated thickness. As shown in FIGS. 1*a* and 1*b*, the blank consists of a conventional central paper body 210 having polyethylene coatings 211 and 212 on its opposite surfaces. Note that the coatings 211 and 212 follow each of the scores such as score 43 shown in FIGS. 1A and 1B. The tab 200 is then folded up and over onto the print side of the blank, as shown in FIG. 1B, so that the raw edge of the blank is covered and the tab is appropriately heat sealed or otherwise secured to the print side of the blank.

The tab 29 is so located that when the container is formed from the blank in the usual manner, the tab 200 will extend directly across and will reinforce the edges of bottom major horizontal scores 54 and 50. Thus, as best shown in FIGS. 6 and 8, the tab 200 is an integral portion of the side seam flap 24 and thus prevents extension or opening of score 54 and is heat sealed across the interior of panel 20 and flap 25 to prevent extension or opening of the horizontal score 50. Therefore, the flap 200 provides substantial reinforcement for the container to prevent extension of the scores 50 and 54 at the bottom corner of the container which has previously been subjected to failure.

Although the present invention has been described in connection with a preferred embodiment thereof, many variations and modifications will now become apparent to those skilled in the art. It is preferred, therefore, that the present invention be limited, not by the specific disclosure herein, but only by the appended claims.

What is claimed is:

1. A blank for forming a container, said blank comprising:

generally rectangular first side panel, second side panel, third side panel, fourth side panel and side seal flap consecutively articulated along parallel score lines;

first through fourth bottom flaps and a bottom seal flap articulated respectively to said first through fourth side panels and said side seal flap along score lines that are generally collinear and are generally perpendicular to the score lines intermediate said first through fourth side panels;

an unscored reinforcing tab extending integrally from at least portions of said bottom seal flap and said side seal flap, whereby on the container erected from said blank, the reinforcing tab extends across the score line between said first side panel and said first bottom panel thereby preventing spreading of the score line when the container is filled; and wherein portions of said first side panel and said first bottom panel generally opposite said second side panel and said second bottom panel include a notch having substantially the identical shape as said reinforcing tab, whereby a plurality of said blanks can be formed from a single sheet of material with the notches in one said blank defining the reinforcing tabs in an adjacent said blank.

2. The blank of claim 1, wherein said reinforcing tab is reduced in thickness from the thickness of the remainder of said blank.

3. The blank of claim 1, wherein blank includes opposed front and rear surfaces, said surfaces being coated with a heat sealable resin.

* * * * *